US009726459B2

(12) United States Patent
Waldrop

(10) Patent No.: US 9,726,459 B2
(45) Date of Patent: Aug. 8, 2017

(54) MULTI-LAYER MULTI-IMPACT BALLISTIC BODY ARMOR AND METHOD OF MANUFACTURING THE SAME

(71) Applicant: Blake Lockwood Waldrop, Dysart, IA (US)

(72) Inventor: Blake Lockwood Waldrop, Dysart, IA (US)

(73) Assignee: RMA Armament, Inc., Rock Island, IL (US)

( * ) Notice: Subject to any disclaimer, the term of this patent is extended or adjusted under 35 U.S.C. 154(b) by 149 days.

(21) Appl. No.: 14/054,260

(22) Filed: Oct. 15, 2013

(65) Prior Publication Data

US 2014/0230638 A1 Aug. 21, 2014

Related U.S. Application Data

(60) Provisional application No. 61/767,536, filed on Feb. 21, 2013.

(51) Int. Cl.
*F41H 5/04* (2006.01)

(52) U.S. Cl.
CPC ..... *F41H 5/0471* (2013.01); *F41H 5/0428* (2013.01); *F41H 5/0492* (2013.01)

(58) Field of Classification Search
CPC . F41H 1/02; F41H 1/00; F41H 5/0471; F41H 5/02; F41H 5/0478; F41H 5/04; F41H 5/0414; F41H 5/0428; F41H 5/0435; F41H 5/0492; F41H 5/08; B32B 2571/02
USPC ..... 89/36.01, 36.02, 36.05; 2/2.5
See application file for complete search history.

(56) References Cited

U.S. PATENT DOCUMENTS 3,239,981 A * 3/1966 Fitzgerald ..... E04F 13/0862 249/65
4,307,140 A * 12/1981 Davis ..... B29C 37/0082 156/276
4,613,535 A * 9/1986 Harpell ..... C08J 5/24 2/2.5
5,349,893 A 9/1994 Dunn
(Continued)

FOREIGN PATENT DOCUMENTS

CA 2171141 A1 * 11/1996 ..... B32B 5/26
GB 1151441 A * 5/1969 ..... F41H 5/0435

OTHER PUBLICATIONS

Ceradyne Cermanic Armor Systems; Advanced Body Armor Systems; Jan. 23, 2013; p. 2 of 3; www.ceradyne.com/products/defense/advanced-body-armor-systems.aspx.
(Continued)

*Primary Examiner* — Benjamin P Lee
(74) *Attorney, Agent, or Firm* — Christopher A. Proskey; BrownWinick Law Firm

(57) ABSTRACT

Multi-impact multi-layer body armor is presented. A first layer is a single layer of front covering material. A second layer, is a ballistic ceramic plate formed of a plurality of curved smaller ceramic tiles that are bonded together using a structural adhesive. A third layer formed of one or a plurality of aramid layers such as Kevlar® XP. A fourth layer formed of a rigid backing plate, formed of ultra-high molecular weight polyethylene such as Spectra Shield®. A fifth layer is a single layer of rear covering material. Thus, an improved body armor is presented which is inexpensive to produce, light, durable and can sustain multiple impacts.

21 Claims, 6 Drawing Sheets

(56) References Cited

U.S. PATENT DOCUMENTS 5,705,764 A * 1/1998 Schade ..... F41H 5/0428 428/911
5,996,115 A * 12/1999 Mazelsky ..... F41H 1/02 2/2.5
6,009,789 A * 1/2000 Lyons ..... F41H 5/0435 2/2.5
6,408,733 B1 * 6/2002 Perciballi ..... F41H 5/0435 2/2.5
6,532,857 B1 * 3/2003 Shih ..... F41H 5/0421 89/36.02
7,300,893 B2 * 11/2007 Barsoum ..... B32B 25/04 2/2.5
7,540,228 B1 * 6/2009 Cronin ..... F41H 5/0421 2/2.5
7,571,493 B1 8/2009 Purvis et al.
7,617,757 B2 * 11/2009 Dickson ..... F41H 5/0414 2/2.5
7,921,757 B1 4/2011 Varvick et al.
7,993,715 B2 * 8/2011 Geva ..... B32B 5/12 2/2.5
8,065,947 B2 * 11/2011 Park ..... F41H 5/0435 428/301.1
8,225,704 B2 * 7/2012 Ogrin ..... C04B 35/053 156/245
8,424,442 B2 * 4/2013 Ward ..... F41H 5/0414 52/385
8,584,570 B1 * 11/2013 Ogrin ..... C04B 35/053 156/245
8,673,103 B2 * 3/2014 Gendlin ..... B29C 43/18 156/247
8,978,536 B2 * 3/2015 Dodworth ..... F41H 5/023 296/187.07
9,187,909 B2 * 11/2015 Lee ..... E04F 15/02038
2005/0005762 A1 * 1/2005 Lujan ..... F41H 5/0414 89/36.02
2005/0066805 A1 * 3/2005 Park ..... F41H 5/0435 89/36.02
2005/0217471 A1 * 10/2005 Benitsch ..... F41H 5/0414 89/36.02
2007/0125223 A1 * 6/2007 Heidenreich ..... F41H 5/0414 89/36.02
2007/0245441 A1 * 10/2007 Hunter ..... F41H 1/02 2/2.5
2009/0229453 A1 * 9/2009 Dickson ..... F41H 5/0414 89/36.02
2009/0269552 A1 * 10/2009 Foldager ..... F41H 5/013 428/172
2009/0320676 A1 * 12/2009 Cronin ..... F41H 5/0421 89/36.05
2010/0229272 A1 9/2010 Crye
2010/0326265 A1 * 12/2010 Park ..... F41H 5/0464 89/36.02
2011/0041676 A1 * 2/2011 Park ..... F41H 5/0435 89/36.02
2011/0088542 A1 * 4/2011 Park ..... F41H 5/0464 89/36.02
2011/0174145 A1 * 7/2011 Ogrin ..... C04B 35/053 89/36.02
2012/0174754 A1 * 7/2012 Salisbury ..... B32B 9/005 89/36.02
2012/0186426 A1 * 7/2012 Ward ..... F41H 5/0492 89/36.02
2012/0216324 A1 * 8/2012 Medwell ..... F41H 1/02 2/2.5
2013/0340602 A1 * 12/2013 Bird ..... F41H 5/0414 89/36.02
2014/0060308 A1 * 3/2014 de Haas ..... F41H 5/0485 89/36.02

OTHER PUBLICATIONS

Wikipedia; Kevlar; Jan. 24, 2013; pp. 1-10; http://en.wikipedia.org/wiki/Kevlar.
Tactex Group; Homepage; Jan. 23, 2013; pp. 1-3; http://tactexfiber.com.
Tactex Group; "Ballistic Fiber"; Jan. 23, 2013; pp. 1-2; http://tactexfiber.com/products/UHMWPE-Fiber/2011111214.html.
Tactex Group; "Stab-resistant Fiber"; Jan. 23, 2013; pp. 1-2; http://tactexfiber.com/products/Protective-Fabric/2011111215.html.
Tactex Group; "Ballistic Plate Material"; Jan. 23, 2013; pp. 1-2; http://tactexfiber.com/products/Ballistic_Plate_Material/2011/1112/16.html.
Tactex Group; "Our Company"; Jan. 23, 2013; pp. 1-2; http://tactexfiber.com/company/.
Tactex Group; "Technology"; Jan. 23, 2013; pp. 1-2; http://tactexfiber.com/technology/.
Tactex Group; "What is Tac-Tex, FAQ"; Jan. 23, 2013; pp. 1-3; http://tactexfiber.com/faq/2011111417.html.

* cited by examiner

MULTI-LAYER MULTI-IMPACT BALLISTIC BODY ARMOR AND METHOD OF MANUFACTURING THE SAME

CROSS REFERENCE TO RELATED APPLICATION

This application claims the benefit of U.S. Provisional Application No. 61/767,536 filed Feb. 21, 2013.

FIELD OF THE INVENTION

This invention relates to body armor. More specifically, and without limitation, this invention relates to multi-layer body armor which is capable of sustaining multiple ballistic impacts.

BACKGROUND OF INVENTION

Body armor is old and known in the art. Since the dawn of time, warriors and soldiers have clad themselves with protective clothing and apparatuses in an attempt to shield their bodies from injury. Initially, this armor was made of naturally occurring materials such as animal skins, leathers, bamboo, wood and combinations thereof. While this early armor was certainly better than no armor at all, it had its disadvantages. Namely, this armor was difficult to work with, it was heavy and bulky and it did not provide much protection to higher levels of impact.

A substantial improvement to body armor occurred with the discovery of metals and the development of manufacturing methods to manipulate metal. Body armor made of metal afforded substantial improvements to impact resistance over the prior armor. While metallic body armor has extremely high impact resistance, it comes at the cost of being extremely heavy.

In the modern era, tightly woven composite fabrics were developed and implemented for use as body armor. The most well-known is Kevlar® which is a registered trademark for a para-aramid synthetic fiber developed by DuPont in 1965. Kevlar® is flexible and has a high tensile strength-to-weight ratio which is 5 times stronger than steel on an equal weight basis. While Kevlar® is strong, lightweight and flexible Kevlar® has its deficiencies. Namely, body armor made of Kevlar® is ineffective at stopping multiple impacts as the material becomes compromised after the first impact. In addition, while Kevlar® may be effective at stopping smaller handgun rounds, Kevlar provides little protection against higher-velocity and higher-impact projectiles such as rifle rounds. A generic name for Kevlar®-type materials is aramid, which is used herein.

Therefore, despite the advances in body armor, problems still remain.

Thus it is a primary object of the invention to provide body armor that improves upon the state of the art.

Another object of the invention is to provide body armor that is lightweight.

Yet another object of the invention is to provide body armor that is low cost to manufacture.

Another object of the invention is to provide body armor that can sustain multiple ballistic impacts.

Yet another object of the invention is to provide body armor that can sustain high ballistic impacts.

Another object of the invention is to provide body armor that breaks a projectile apart when the projectile hits the body armor.

Yet another object of the invention is to provide body armor stops a projectile when the projectile hits the body armor.

Another object of the invention is to provide body armor that is comfortable to wear.

Yet another object of the present invention is to provide body armor that has multiple layers that perform different functions when struck by a projectile.

Another object of the invention is to provide body armor that is durable.

These and other objects, features, or advantages of the present invention will become apparent from the specification, claims and drawings.

SUMMARY OF THE INVENTION

Multi-impact multi-layer body armor is presented. In one arrangement, the body armor has a first layer which is a single layer of covering material such as Tac-Tex or polyester which serves as the strike face of the body armor. The second layer, is a ballistic ceramic plate formed of a plurality of smaller ceramic tiles that are bonded together using an adhesive binder. These individual ceramic tiles are arcuately curved, which when the individual ceramic tiles are bonded together form a larger curved plate. The third layer, positioned behind and connected to the ceramic plate is a plurality of aramid layers, which in one arrangement are formed of approximately eleven layers of Dupont Kevlar® XP. The fourth layer, positioned behind and connected to the aramid layers, is a rigid backing plate, which in one arrangement is formed of approximately thirty-six layers of ultra high molecular weight polyethylene, which in one arrangement are formed of Honeywell Spectra Shield® II. These layers are hot pressed together with an adhesive to form a single unitary rigid piece. The fifth layer, a single layer of covering material such as Tac-Tex or polyester, serves as the rear covering material. Because the ceramic plate is slightly small than the other layers, a foam layer is positioned around the exterior edges of the ceramic plate. In addition, foam piping is positioned around the exterior edge of the combined layers. A fabric band is positioned around the exterior edge of all the layers and connects the first layer to the last layer thereby sealing the body armor. Thus, an improved body armor is presented which is inexpensive to produce, light, durable and can sustain multiple impacts.

DETAILED DESCRIPTION OF THE INVENTION

Figure 1:
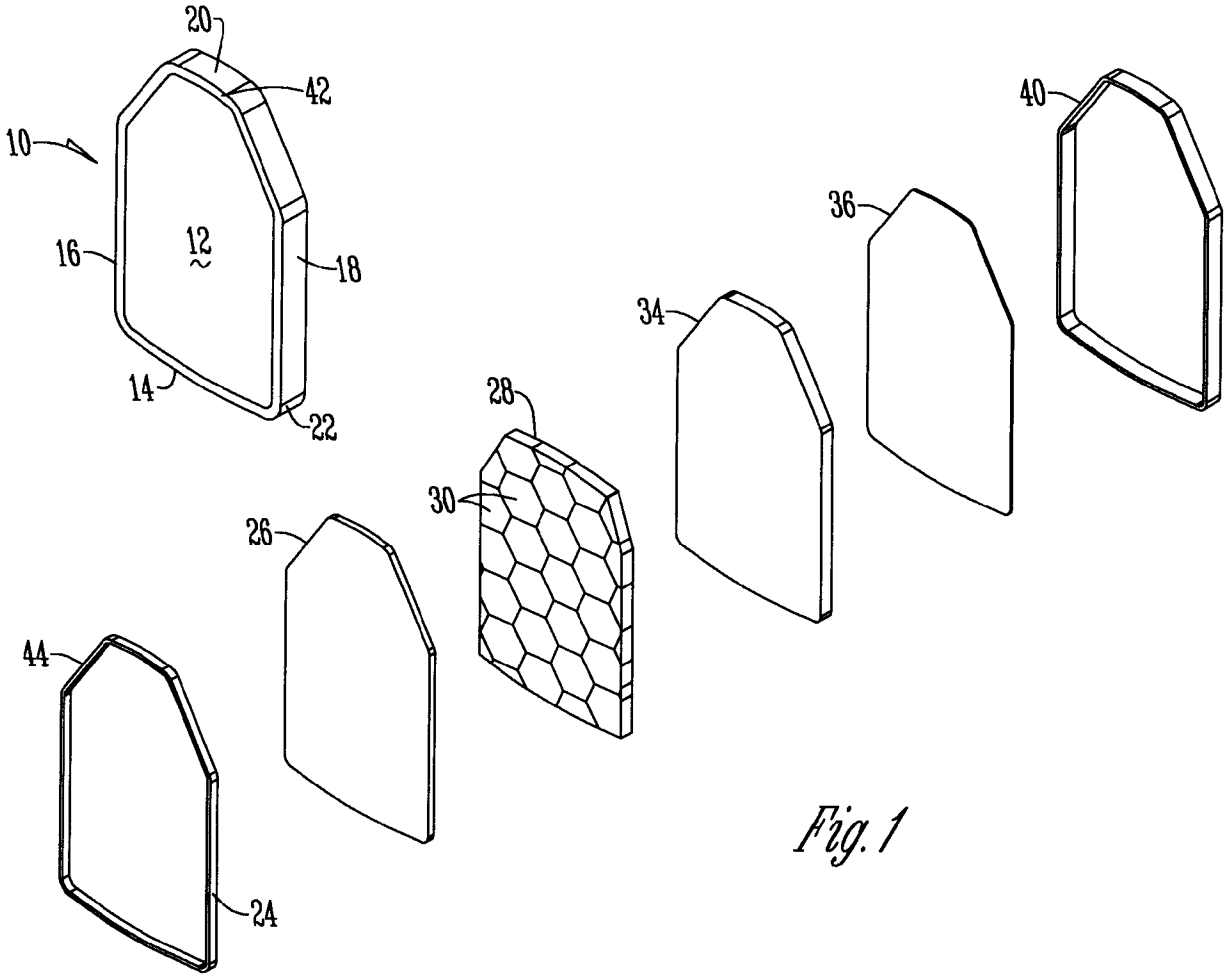
FIG. 1 is perspective blown-up view of the body armor.

With reference to the drawings, body armor 10 is presented. Body armor 10 has a front side 12 also known as the impact side or strike face, a back side 14 opposite the front side 12, a left side 16, a right side 18, a top side 20 and a bottom side 22. Body armor 10 is comprised of a plurality of layers. While body armor 10 is of a generally constant thickness, body armor 10 slightly arcuately curves from front 12 to back 14, so as to provide a better ergonomic fit for the user. In addition, while in one arrangement body armor, when viewed from the front 12 is generally square or rectangular, in another arrangement, the upper corners are chamfered or rounded, so as to provide additional freedom of motion for the user's arms. In another arrangement, the bottom corners are also chamfered or rounded, or alternatively, body armor 10 takes any shape desired, such as round, oval, or any other geometric shape or shapes.

A first embodiment of the body armor 10 is as follows.

First Layer 24—Exterior Ballistic Fiber:

The first layer 24 or cover layer of body armor 10 is a layer of ballistic fiber. The first layer 24 provides the exterior surface of the body armor 10. This first layer 24 of ballistic fiber may comprise of only a single layer of material, or alternatively this layer of ballistic fiber 24 may comprise two, three or more layers of ballistic fiber which are stacked on top of one another. The number of layers of ballistic fiber and the thickness of each of these layers can be increased or decreased depending on the application. As the layers become thicker and the number of layers increase, so does the ability of the first layer 24 to stop impacts. In the event that a plurality of layers are used, they are either bonded to one another to form a single sheet with the use of adhesive, heat, pressing, stitching, gluing, welding or any other process; or alternatively, each of these layers are not bonded to one another and instead are merely positioned in overlapping condition with one another.

In one arrangement ballistic fiber 24 is a sheet, or a plurality of sheets of ultra-high-molecular-weight (UHMW) material or ultra-high-molecular-weight-polyethylene (UHMWPE). UHMWPE is a subset of the thermoplastic polyethylene. Also known as high-modulus polyethylene, (HMPE), or high-performance polyethylene (HPPE), it has extremely long chains, with a molecular weight usually between 2 and 6 million. UHMWPE is a type of polyolefin. It is made up of extremely long chains of polyethylene, which all align in the same direction. It derives its strength largely from the length of each individual molecule (chain). Van der Waals bonds between the molecules are relatively weak for each atom of overlap between the molecules, but because the molecules are very long, large overlaps can exist, adding up to the ability to carry larger shear forces from molecule to molecule. Each chain is bonded to the others with so many Van der Waals bonds that the whole of the inter-molecule strength is high. In this way, large tensile loads are not limited as much by the comparative weakness of each Van der Waals bond. When formed to fibers, the polymer chains can attain a parallel orientation greater than 95% and a level of crystallinity from 39% to 75%. In contrast, Kevlar derives its strength from strong bonding between relatively short molecules.

The simple structure of the molecule also gives rise to surface and chemical properties that are rare in high-performance polymers. For example, the polar groups in most polymers easily bond to water. Because olefins have no such groups, UHMWPE does not absorb water readily, nor wet easily, which makes bonding it to other polymers difficult. For the same reasons, skin does not interact with it strongly, making the UHMWPE fiber surface feel slippery. In a similar manner, aromatic polymers are often susceptible to aromatic solvents due to aromatic stacking interactions, an effect aliphatic polymers like UHMWPE are immune to. Since UHMWPE does not contain chemical groups (such as esters, amides or hydroxylic groups) that are susceptible to attack from aggressive agents, it is very resistant to water, moisture, most chemicals, UV radiation, and micro-organisms.

In one arrangement, the UHMWPE used for the first layer 24 is Tac-Tex™ Ballistic Fiber manufactured by TAC International Corp. It is advertised that Tac-Tex™'s shock intensity is 15 times that of high-quality steel, the impact energy absorption is 2.6 times aramid. Tac-Tex™ is lightweight and flexible. One benefit to using Tac-Tex™ over Kevlar® is that while Tac-Tex™ is not as strong as Kevlar® in some ways, Tac-Tex™ is lighter. Alternatively, first layer 24 is formed of any other high strength material such as an aramid like Kevlar®, Nomex®, Technora® or Kevlar® XP.

Kevlar® is the well-known trademark for DuPont's material formed of Poly-paraphenylene terephthalamide. Kevlar is synthesized in solution from the monomers 1,4 phenylene-diamine (paraphenylendiamine) and terephthaloyl chloride in a condensation reaction yielding hydrochloric acid as a byproduct. The result has liquid crystalline behavior, and mechanical drawing orients the polymer chains in the fiber's direction. Hexamethylphosphoramide (HMPA) was the solvent initially used for the polymerization, but for safety reasons, DuPont replaced it by a solution of N-methyl-pyrrolidone and calcium chloride. Kevlar (poly paraphenylene terephthalamide) production is expensive because of the difficulties arising from using concentrated sulfuric acid needed to keep the water-insoluble polymer in solution during its synthesis a spinning. Several grades of Kevlar are available: (1) Kevlar K-29—in industrial applications, such as cables, asbestos replacement, brake linings, and body/vehicle armor; (2) Kevlar K49—high modulus used in cable and rope products; (3) Kevlar K100—colored version of Kevlar; (4) Kevlar K119—higher-elongation, flexible and more fatigue resistant; (5) Kevlar K129—higher tenacity for ballistic applications; (6) Kevlar AP—has 15% higher tensile strength than K-2; (7) Kevlar XP—lighter weight resin and KM2 plus fiber combination; (8) Kevlar KM2—enhanced ballistic resistance for armor applications, Kevlar® XP or another Kevlar or aramid is hereby contemplated for this use as the first layer 24 as well.

Alternatively, the first layer 24 is made of a non-ballistic material, such as cloth, felt, canvas, flannel, denim, polyester, nylon, plastic or any other material, which while not having substantial impact resistance, is useful in covering the body armor 10, holding the interior layers of body armor 10 together, and making the body armor 10 comfortable for wear and use. In addition, the outer layer can serve to keep the body armor 10 clean and dry, and be easily washed.

In one arrangement, a padding material 25 is positioned behind and/or connected to first layer 24. Padding material 25 is any material which is compressible, soft or absorbs shocks. In one arrangement, padding material 25 provides some cushioning so as to make the body armor more comfortable to wear and use. Alternatively, padding material 25 may also be water or moisture absorptive, so as to absorb sweat from use, thereby also making the body armor 10 more comfortable to wear and use.

Second Layer 26—Ballistic Fiber:

Second layer 26 of body armor 10 is positioned behind the first layer 24. The second layer 26 may be made of the same material as first layer 24 or cover layer, or alternatively second layer 26 may be made of a different material as the first layer 24. The second layer 26 may be made of a single layer of material or a plurality of layers of material.

In one arrangement which has been tested with success, second layer 26 comprises 4 or 5 layers of Tac-Tex™ which amount to about 1/16 to 1/8 to 3/16 of an inch in thickness. In this arrangement, the layers of Tac-Tex™ are cut to shape and stacked in overlapping condition to one another. These layers are either bonded to one another to form a single sheet of material with the use of adhesive, heat, pressing, stitching, gluing, welding or any other process; or alternatively, each of these layers are not bonded to one another and instead are merely positioned in overlapping condition with one another. More or less layers of material are hereby contemplated to increase or decrease the impact resistance of body armor 10 such as 1-3 layers, 5-10 layers, 10-20 layers, 20-30 layers, 30-40 layers, 40-50 layers, or more. Other thicknesses have also been contemplated including 1/32", 3/32" 5/32", 7/32", 1/4", 9/32", 5/16", 11/32", 3/8" 13/32", 7/16", 15/32", 1/2", 17/32", 9/16", 19/32", 5/8", 21/32", 11/16", 23/32", 3/5", 25/32", 13/16", 27/32", 7/8", 29/32", 15/16", 31/32" and 1" or more.

Alternatively, any other ballistic material such as aramid or any Kevlar® is used for the second layer 26. Alternatively, more than one material is used for the second layer 26, such as using a layer of Tac-Tex, followed by a layer of Kevlar®, followed by a layer of Tac-Tex, and so on; or alternatively two layers of Tac-Tex are followed by two layers of Kevlar®, and so on. As such, any combination of layers of ballistic material are hereby contemplated for second layer 26.

In one arrangement, second layer 26 is merely positioned in overlapping condition behind first layer 24 without being connected directly to one another. Alternatively, first layer 24 and second layer 26 are bonded to one another with the use of adhesive, heat, pressing, stitching, gluing, welding or any other process.

Third Layer 28—Armor Plate:

Third layer 28 of body armor 10 is positioned behind the first layer 24 and second layer 26. Third layer 28 is a hard armor plate.

In one arrangement, third layer is a hard ceramic armor plate made of any form of ceramic material such as Alumina Silicon, Aluminum Oxide ($Al_2O_3$) ceramic tile, hot pressed boron carbide and/or silicon carbide which is useful in stopping and/or breaking up projectiles. In one arrangement, the ceramic plate is formed of a single unitary ceramic plate. Alternatively, the overall ceramic plate is formed of a plurality of smaller ceramic tiles 30 which are bonded together.

In the arrangement wherein the armor plate 28 is formed of a plurality of smaller ceramic tiles 30, the smaller ceramic tiles 30 are positioned in end-to-end alignment with one another, or in overlapping condition with one another, either in one single layer or, for added protection, in a plurality of layers in a mold 32 made of steel, metal or any other suitable material which is contoured and sized in the desired overall shape for the armor plate 28. Once the small ceramic tiles 30 are properly aligned, an adhesive is coated over the small ceramic tiles 30. Once fully coated, the mold 32 and ceramic plate is baked, which melts the adhesive which flows over, through and in-between the small ceramic tiles 30 thereby smoothing the exterior surface and binding the small ceramic tiles 30 together into a single plate. For additional bonding, pressure is added to the mold, and/or the adhesive is pressurized. In one arrangement, the adhesive is put over the exterior and interior surfaces of the combined individual ceramic tiles 30 in a single or multiple thin sheet. Once heated and/or pressurized, the adhesive flows into and around the small ceramic tiles 30.

One manufacturer of suitable ceramic tiles 30 is Ceradyne, Inc. of Costa Mesa, Calif. which produces Aluminum Oxide, boron carbide and silicon carbide plates and tiles. Another manufacturer of ceramic plates and tiles is CerCo, LLC of Shreve, Ohio which produces aluminum oxide with magnesium oxide plates and tiles. However, any other manufacturer of ballistic ceramic plates and tiles which are suitable for this application are hereby contemplated.

Figure 2:
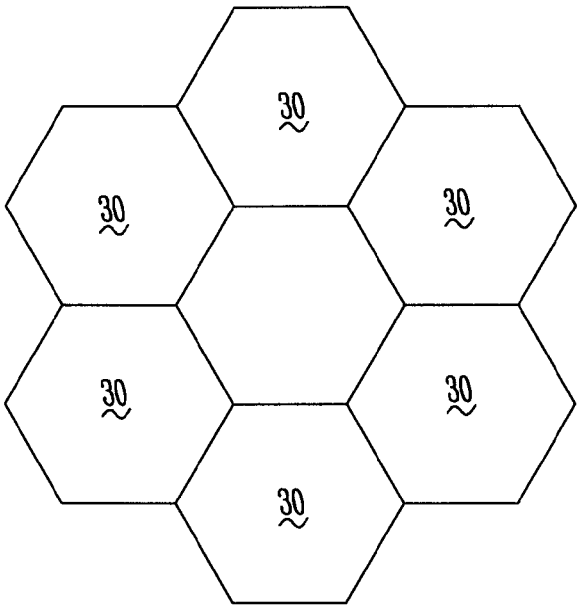
FIG. 2 is a plan view of a portion of an armor plate formed of a plurality of individual hexagonal ceramic tiles positioned in end-to-end alignment.
Figure 3:
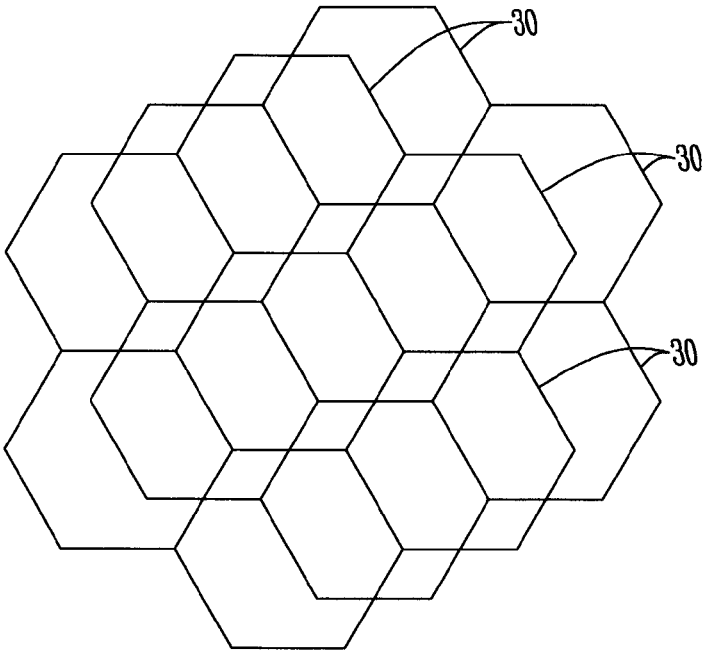
FIG. 3 is a plan view of a portion of an armor plate formed of two layers of a plurality of individual hexagonal ceramic tiles positioned in end-to-end alignment, the dual layers providing additional protection from a projectile passing between a seam in the individual hexagonal ceramic tiles.
Figure 4:
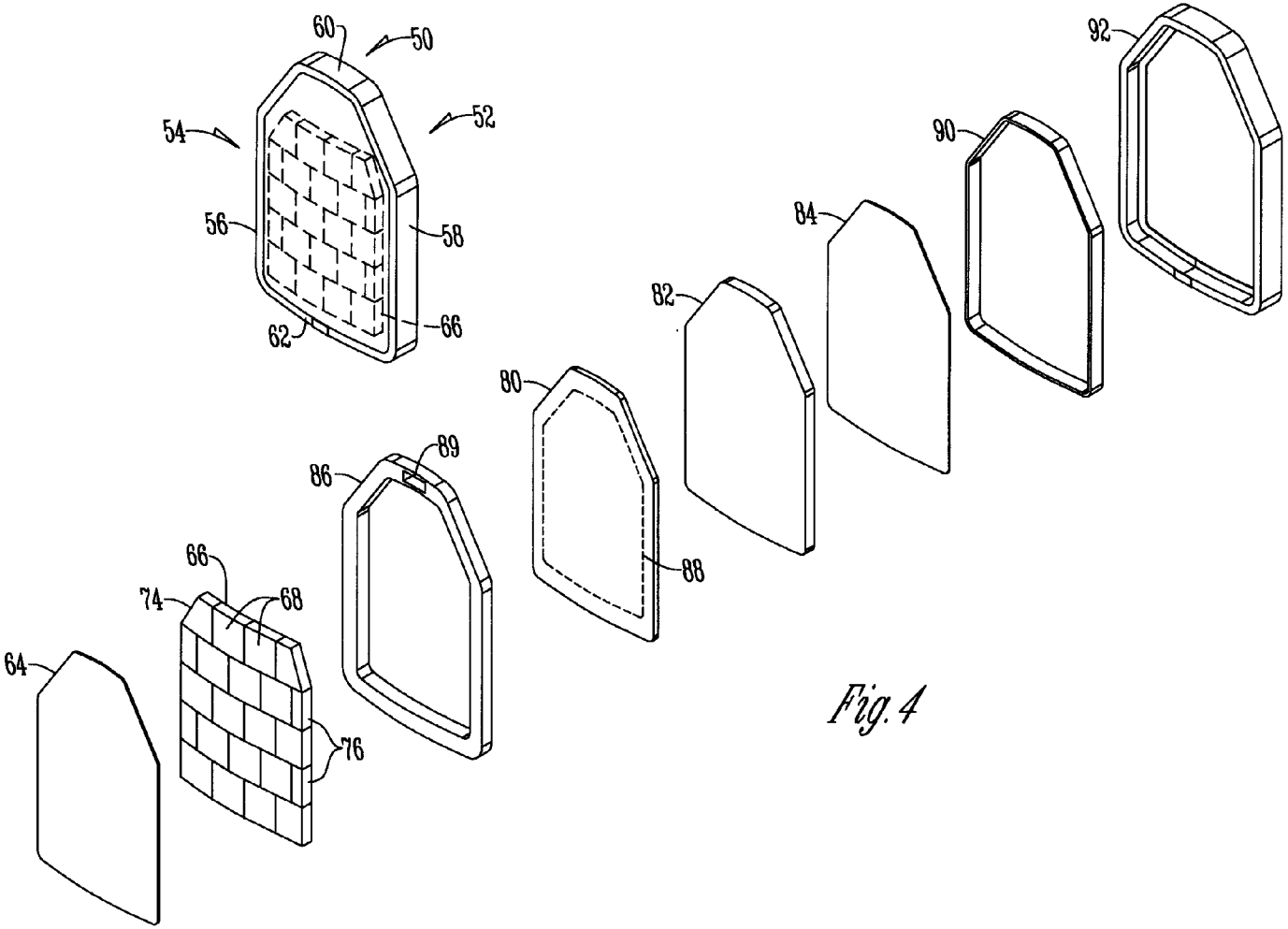
FIG. 4 is a perspective and exploded view of an alternative embodiment of body armor.

In one arrangement, the individual ceramic tiles 30 are symmetrical 6-sided hexagons having a flat front face 12 and a flat back face 14 which extend in planar parallel spaced relation. Each side of these hexagon tiles are straight. When assembled, the edges of each hexagon plate are positioned in end-to-end flush mating arrangement so as to ensure that no space is left between adjacent ceramic tiles 30. (See FIG. 2). To provide additional protection, and to ensure that no projectile passes between the seam of two tiles, a second layer of ceramic tiles 30 is positioned in overlapping, but offset condition. (See FIG. 3). In an alternative arrangement, these hexagonal tiles are curved.

Other shaped tiles are also hereby contemplated, including triangle, square, rectangular, pentagon, heptagon, octagon, star, trapezoid, diamond, round, oval, or any other shape. Shapes which flushly engage its equal to form a seamless array work well as they engage one another and prevent seams.

In one arrangement tiles having a thickness of 1/4" have been tested with success. Although other thicknesses are also hereby contemplated including 1/32", 1/16", 3/32" 1/8", 5/32", 3/16", 7/32", 1/4", 9/32", 5/16", 11/32", 3/8" 13/32", 7/16", 15/32", 1/2", 17/32", 9/16", 19/32", 5/8", 21/32", 11/16", 23/32", 3/5", 25/32", 13/16", 27/32", 7/8", 29/32", 15/16", 31/32", 1"; or an inch plus any of these thicknesses; or the like. In the event that two layers are used in overlapping and/or offset condition, the thickness of each layer is halved.

In the arrangement where hexagon tiles are used, hexagons having a length of 1&1/4" from point-to-point have been used with success. However, any other point-to-point sized hexagons are hereby contemplated, including 1/4", 1/2", 3/4", 1", 1&1/2", 1&3/4", 2", 2&1/4", 2&1/2", 2&3/4", 3", 3&1/4", 3&1/2", 3&3/4", 4" or the like. Similarly, when square or rectangular tiles are used, while 2" tiles have been used with success, measured from side-to-side, any other side-to-side sized square or rectangular tiles are hereby contemplated, including 1/4", 1/2", 3/4", 1", 1&1/4" 1&1/2", 1&3/4", 2&1/4", 2&1/2", 2&3/4", 3", 3&1/4", 3&1/2", 3&3/4", 4" or the like.

Using a plurality of smaller tiles 30, as opposed to a single unitary ceramic plate, provides a number of substantial advantages. Namely, when a projectile hits a single unitary plate, the projectile tends to shatter the entire plate, thereby compromising the single unitary ceramic plate after the first hit, which reduces or eliminates the ceramic plate's ability to stop a second, third, or fourth round. When a plurality of ceramic tiles 30 are used, only the tiles 30 which are actually stricken by the projectile are compromised, leaving the remaining tiles 30 in pristine condition to prevent other projectiles. In addition, by using a plurality of ceramic tiles 30, the body armor 30 can be arcuately bent so as to form a more comfortable body armor for use. Alternatively, the individual ceramic tiles 30 are arcuately curved themselves.

In the arrangement wherein hexagonal small tiles 30 are used approximately 20-30 tiles are hereby contemplated for use in a single layer, doubled for dual layers, and so on. However, any other amount of tiles are hereby contemplated, such as 1-10, 10-15, 15-25, 30-40, 40-50, 50-60, 60-70, 70-80, 80-90, 90-100, or more, or any range inbetween. In the arrangement wherein square or rectangular small tiles 30 are used approximately 15-25 tiles are hereby contemplated for use in a single layer, doubled for dual layers, and so on. However, any other amount of tiles are hereby contemplated, such as 1-10, 10-15, 20-30, 30-40, 40-50, 50-60, 60-70, 70-80, 80-90, 90-100, or more, or any range inbetween. As the size of the body armor 10 increases, so does the number of tiles required.

Fourth Layer 34—Ballistic Fiber:

The forth layer 34 is another layer of ballistic fiber. The fourth layer 34 may be made of the same material as first layer 24 and/or second layer 26, or may be made of a different material than either the first layer 24 or second layer 26. The fourth layer 34 may be made of a single layer of ballistic fiber or made of multiple layers of ballistic fiber.

In one arrangement, the fourth layer 34 is made of multiple layers of Kevlar® XP. It is hereby contemplated that the fourth layer is made of many layers, from 2 layers up to or 100, or 200, or 300, or 400 or any amount inbetween, or more layers of ballistic fiber. However 35-40 layers of Kevlar® XP have been tested with success, which amount to about 1/16 to 1/8 to 3/16 of an inch in thickness. Other thicknesses have also been contemplated including 1/32", 3/32" 5/32", 7/32", 1/4", 9/32", 5/16", 11/32", 3/8" 13/32", 7/16", 15/32", 1/2", 17/32", 9/16", 19/32", 5/8", 21/32", 11/16", 23/32", 3/5", 25/32", 13/16", 27/32", 7/8", 29/32", 15/16", 31/32" and 1" or more.

In this arrangement, the multiple layers of ballistic fiber are cut to the same dimensions and laid in flat-overlapping condition with one another. The layers are either counted by hand or by machine to ensure that the appropriate number of layers are used. Alternatively, the layers are weighed to ensure the appropriate number of layers are used.

Fifth Layer 36—Polyethylene Fiber:

The fifth layer 36 is layer of polyethylene fiber. The fifth layer is in one arrangement made of a polyethylene fiber that is strong, thin, light, flexible, and has good impact resistance as well as good energy dispersal characteristics. Spectra® and/or Spectra Shield® fiber manufactured by Honeywell has been tested with success as the fifth layer 36.

Spectra® or Spectra Shield® fiber is a bright white polyethylene fiber that is produced using a gel-spinning process. Pound-for-pound, it is 15 times stronger than steel, more durable than polyester and has a specific strength that is 40 percent greater than aramid fiber. Polyethylene is a remarkably durable plastic. Spectra® is one of the world's strongest and lightest fibers. The gel-spinning process and subsequent drawing steps allow Spectra fiber to have a much higher melting temperature (150° C. or 300° F.) than standard polyethylene.

Spectra® displays outstanding toughness and extraordinary visco-elastic properties, Spectra® fiber can withstand high-load strain-rate velocities. Light enough to float, it also exhibits high resistance to chemicals, water, and ultraviolet light. It has excellent vibration damping, flex fatigue and internal fiber-friction characteristics, and Spectra fiber's low dielectric constant makes it virtually transparent to radar.

In one arrangement a plurality of polyethylene fiber layers are placed in overlapping condition with one another. It is hereby contemplated that the fifth layer 36 is comprised of several layers up to hundreds of layers of polyethylene fiber including 10, 20, 30, 40, 50, 75, 100, 200, 300, 400, 500, 600, 700, 800, 900, 1,000 or more layers or any amount inbetween. The layers are either counted by hand or by machine to ensure that the appropriate number of layers are used. Alternatively, the layers are weighed to ensure the appropriate number of layers are used.

In one arrangement several hundred layers of polyethylene fiber have been tested in Level III body armor that amount to approximately 1/2" thick, Level IV body armor has been tested having a polyethylene fiber layer that amount to approximately 3/4" thick.

Joining of Fourth Layer 34 and Fifth Layer 36:

In one arrangement, once cut and stacked, the fourth layer 34 and fifth layer 36 are positioned in overlapping condition. Next, the fourth layer 34 and fifth layer 36 are coated with or dipped into a bonding adhesive and placed into a hot press. Pressure and heat are used to bond the plurality of layers together. The bonding adhesive is forced around and throughout the plurality of layers forcing the air pockets out of the layers and compressing the layers together. Once cooled and hardened, resulting product is a single unitary rigid piece 38 that is formed in the desired shape that has a forward side which is comprised of a plurality of layers of a ballistic fiber, and a rearward side formed of a plurality of layers of polyethylene fiber. In an alternative arrangement, the fourth layer 34 and the fifth layer 36 are joined only by adhesive and not hot pressed.

Joining the Ceramic Plate 28 with the Rigid Piece 38:

Once the fourth layer 34 and fifth layer 36 are joined together to form the rigid piece 38, the rigid piece 38 is connected to the back side 14 of the ceramic armor plate. Adhesive is placed on the back side 14 of the armor plate 28 and/or on the front side 12 of the rigid piece 38. Next the armor plate 28 and the rigid piece 38 are positioned in a mold in overlapping condition and stamped together. This stamping process uses pressure, heat and adhesive to bind the two layers 28, 38 into a single unitary piece.

Joining the Second Layer 26 to the Ceramic Plate 28:

In one arrangement, second layer 26 is merely positioned in overlapping condition in front of ceramic plate 28 without being connected directly to one another. Alternatively, once the ceramic plate 28 is formed and the second layer 26 is formed, the two can be joined together by placing adhesive on the back side 14 of the second layer 26 and/or on the front side 12 of the ceramic plate 28. The armor plate 28 and the second layer 26 are positioned in a mold in overlapping condition and stamped together to improve bonding. This stamping process uses pressure, heat and adhesive to bind the two layers 26, 38 into a single unitary piece. This joining can occur before or after the ceramic plate 28 is joined with the rigid piece 38.

Sixth Layer 40—Exterior Ballistic Fiber:

The sixth layer 40 is like the first layer 24 and provides the exterior surface of the body armor 10, as well as some protection. This sixth layer 40 is made of ballistic fiber, such as Tac-Tex™ as is described herein and may comprise of only a single layer of material, or alternatively may comprise two, three or more layers of ballistic fiber which are stacked on top of one another. The number of layers of ballistic fiber and the thickness of each of these layers can be increased or decreased depending on the application. As the layers become thicker and the number of layers increase, so does the ability of the sixth layer 40 to stop impacts. In the event that a plurality of layers are used, they are either bonded to one another to form a single sheet with the use of adhesive, heat, pressing, stitching, gluing, welding or any other process; or alternatively, each of these layers are not bonded to one another and instead are merely positioned in overlapping condition with one another.

In one arrangement, sixth layer 40 is merely positioned in overlapping condition behind rigid piece 38 without being connected directly to one another. Alternatively, sixth layer 40 and rigid piece 38 are bonded to one another with the use of adhesive, heat, pressing, stitching, gluing, welding or any other process.

Alternatively, the sixth layer 40 is made of a non-ballistic material, such as cloth, felt, canvas, flannel, denim, polyester, nylon, plastic or any other material, which while not having substantial impact resistance, is useful in covering the body armor 10, holding the interior layers of body armor 10 together, and making the body armor 10 comfortable for wear and use. In addition, the outer layer can serve to keep the body armor 10 clean and dry, and be easily washed.

Joining the First Layer 24 to the Sixth Layer 40:

In one arrangement, the first layer 24 and the sixth layer 40 extend beyond the borders of the other components of body armor 10. This flange area 42 of first layer 24 and sixth layer 40 are then joined together by any means known in the art such as stitching, gluing, welding or any other means thereby sealing body armor 10 and locking or clam-shelling the other components of body armor 10 therebetween. Once the first layer 24 and sixth layer 40 are joined together, the excess material is cut away for aesthetic and comfort purposes.

Alternatively, the first layer 24 and sixth layer 40 are formed of the same piece of material which is simply wrapped around the other components of body armor 10. Once wrapped around the other components of body armor 10, this single piece of material is then connected to itself, as is described above, and the excess is removed. In this arrangement a single seam is located in the center of the back side 14 of the body armor 10.

Joining All Layers Together:

In another arrangement, all layers described herein, are placed in a mold and pressed together with pressure, heat and adhesive. The pressure and heat activates the adhesive and binds all layers together. This inter-layer cohesion, or the cohesion between each layer, creates a single, albeit multilayered piece of body armor, which improves the strength and impact resistance of the body armor 10.

Foam Piping:

A layer of piping 44 is positioned around the exterior periphery of all layers. This piping 44 is made of any compressible material such as foam, rubber, Styrofoam, gel, or any other flexible and compressible material. Piping provides an amount of give and cushion to the edge of body armor 10 which improves the comfort of wearing body armor 10.

In Operation:

In operation, body armor 10 is placed in the vest of user. Upon impact from a bullet or other projectile, the bullet engages and likely passes through the exterior surface of the vest and impacts the strike face or first layer 24 of body armor 10. Upon initial impact, the first layer 24 of ballistic material, which is in one arrangement Tac-Tex™, begins the initial velocity brake of the projectile in motion. This begins the absorption of the kinetic energy of the bullet by the body armor 10 and begins to deform the bullet. Next, the bullet begins to engage the multiple layers ballistic material which form the second layer 26 which are positioned directly behind the first layer 24. Each additional layer of ballistic material provides additional protection and supports the absorption of kinetic energy from the bullet and causes additional deformation of the bullet. Next, the bullet engages the hard ceramic armor plate 28 which continues the absorption and dispersion of kinetic energy from the bullet. The ceramic armor plate 28 also serves to break the bullet into pieces thereby reducing the kinetic energy of each individual piece. The ceramic armor plate 28 also breaks apart when struck by the bullet.

When because the ceramic armor plate 28 is formed of a plurality of smaller ceramic tiles 30 when the bullet engages any one of these smaller ceramic tiles 30 the impacted small ceramic plate 30 cleaves, shatters and breaks apart as does the bullet. However, because the ceramic plate 28 is made of a plurality of smaller ceramic tiles 30, the adjacent smaller tiles 30 do not break apart. The other smaller ceramic tiles 30 are fully able to stop additional bullets as they themselves have not been impacted. This is a substantial improvement over the prior art which consists of only a single unitary solid ceramic plate, which when struck by a bullet, the entire plate shatters, leaving little to no protection from other bullets.

Also, in the event that the bullet strikes the intersection of two or more smaller ceramic tiles 30, the bullet shatters the smaller ceramic tiles 30 that it strikes, but it does not pass through. Due to the strong adhesion between adjacent ceramic tiles 30, as well as the small ceramic tiles 30 being bonded to layers on both the front 12 and the back side 14, the bullet does not pass through, and shatters the tiles it strikes, while shattering itself and leaving the remaining portions of the body armor intact.

For additional protection from a strike at the intersection of two smaller ceramic tiles 30, there are two or more layers of small ceramic tiles 30 positioned in overlapping and offset condition. In this way, there are no seams for the bullet to pass through.

Next, after striking the ceramic layer, the bullet engages the rigid piece 38. First the bullet engages the fourth layer 34 which comprises a plurality of layers of ballistic fiber which are bonded together, such as 35-40 layers of Kevlar® XP which begins the rapid absorption of kinetic energy and velocity from the bullet. Next the bullet engages the fifth layer 36 which comprises a plurality of layers of polyethylene fiber which are bonded together, such as several hundred layers Spectra® which stops all of the bullet's motion and displaces the remaining kinetic energy into its fibers. The sixth layer 40 of ballistic fiber, such as a single layer of Tec-Tex, acts as a final stop against any remaining force and displaces the remaining blunt force trauma.

Test Results:

April, 2012: One hit from a 55 gr FMJ .223 DPMS AR-15 on a Level III plate. One additional hit from a 168 gr 30-06 round.

May, 2012 Two hits from a 55 gr FMJ .223 DPMS AR-15 on a Level III plate. Two additional hits from a 165 gr .308 DPMS AR-10. Two additional hits from a GLOCK 21 .45

One hit on a Level IV plate with a 7 mm Remington Magnum BDL. One hit from a 260 gr 12 gauge shotgun slug. Nine hits from armor penetrating Hornady .40 rounds.

Two hits on a Level IV with a Remington .300 WinMag 168 gr FMJ rounds from 250 yards.

The Level III body armor plate will stop all small arms munitions including 7.62 mm, 5.56 mm, .223, .308 and other assorted rifle munitions and is also rated to take one hit from a .30-06.

The Level IV body armor plate will stop all small arms munitions including 7.62 mm, 5.56 mm, .223, .308 and other assorted rifle munitions and is also tested against a point blank 12 gage shotgun, a .300 Winchester Magnum, a .30-06 among many other high powered munitions.

Differences Between Level III and Level IV Armor:

Level III body armor is rated and tested to stop all small arms munitions such as .45, .357, .44, .40, 9 mm. The Level III body armor was tested against the following rifle rounds .30-06 (only 1 hit rated. Tested on April 2012 against a 165 gr round at 2,900 fps), .223 (2 hit rated), .308 (2 hit rated). The level IV body armor is also rated and tested to stop all of the above as the following rifle and shotgun rounds, .30-06 (1 hit tested using a steel core round), .223 (8 hit rated using 55 gr FMJ rounds), .308 (2 hit rated from a DPMS Panther AR-10), 12 gauge 260 gr slug (tested point blank), .300 168 gr Winchester Magnum FMJ (2 round tested).

Level III body armor has approximately ¾" of overall thickness, and Level IV body armor has approximately 1" of overall thickness. The ceramic plate 30 of the Level III body armor is made of smaller hexagonal tiles (such as 1&¼" tip-to-tip), whereas the Level IV body armor is made of slightly larger square tiles (such as 2" squares). Also, the Level III body armor has a polyethylene fiber layer 36 that is approximately ½" thick whereas the Level IV has a polyethylene fiber layer 36 that is approximately ¾" thick.

Alternative Arrangement of Body Armor:

An alternative arrangement of body armor 50 is presented. Body armor 50 has a front side 52 also known as the impact side or strike face, a back side 54 opposite the front side 52, a left side 56, a right side 58, a top side 60 and a bottom side 62. Body armor 50 is comprised of a plurality of layers as are described herein. While body armor 50 is of a generally constant thickness, body armor 50 slightly arcuately curves from front 52 to back 54, so as to provide a better ergonomic fit for the user. In this arrangement, when viewed from the front side 52 the upper corners are chamfered or rounded, so as to provide additional freedom of motion for the user's arms.

First Layer 64—Cover Material:

The first layer 64 or front cover layer of body armor 50 provides the exterior surface of the body armor 50. This first layer 64 is formed of only a single layer of material, or alternatively two, three or more layers of material which are stacked on top of one another for added protection. The number of layers of material and the thickness of each of these layers can be increased or decreased depending on the application. In the event that a plurality of layers are used, they are either bonded to one another to form a single sheet with the use of adhesive, heat, pressing, stitching, gluing, welding or any other process; or alternatively, each of these layers are not bonded to one another and instead are merely positioned in overlapping condition with one another.

In the arrangement shown, first layer 64 is formed of a polyester material that is water resistant and/or water proof. Being water resistant or water proof helps to keep the body armor 50 clean and dry. This is especially important considering that body armor 50 is often held close to the body and therefore is often exposed to high moisture levels for extended periods of time. In addition, various components of body armor 50 are adversely affected by water and/or moisture.

A countless number of materials are suitable for this application, including a broad array of polyesters, nylons and the like. One material that has been tested with success includes black 78T 600 Denier Polyester with a Urethane coating (impregnated into the material and/or positioned on the inside surface of the material) & DWR. This material is slick to the touch and therefore allows for easy insertion and removal into a vest. In addition, the urethane coating provides a strong moisture barrier.

Second Layer 66—Armor Plate:

Second layer 66 of body armor 50 is positioned behind the first layer 64. Second layer 66 is a hard armor plate.

Second layer 66 is formed of a hard ceramic armor plate made of any form of ceramic material such as Alumina Silicon, Aluminum Oxide ($Al_2O_3$) ceramic tile, hot pressed boron carbide and/or silicon carbide which is useful in stopping and/or breaking up projectiles.

In the arrangement shown the armor plate 66 is formed of a plurality of smaller ceramic tiles 68. The smaller ceramic tiles 68 are positioned in end-to-end alignment with one another, either in one single layer, however multiple layers are hereby contemplated.

In the arrangement shown, the individual small ceramic tiles are approximately square when viewed from the front or the back. The individual small ceramic tiles are approximately 2 inches by 2 inches, with a thickness of between ¼ of an inch to 1 inch, more specifically approximately ½ of an inch. However any other size and shape is hereby contemplated.

The individual tiles also arcuately curve from their front side to their back side. That is, when viewed from above or below, the individual small ceramic tiles 68, have a slight curvature, or take the shape of a partial portion of a cylinder. In this arrangement, the outside left 56 and right 58 sides are perpendicular to the front 52 and back 54 sides, and therefore the left 56 and right 58 sides are positioned at a slight angle to one another. In this way, a plurality of individual ceramic tiles 68 can be stacked side to side with flat and flush sides face engagement. When stacked together in this manner, the plurality of individual small ceramic tiles 68 form a single continuous arcuate armor plate 66.

Care is taken to ensure that the left 56, right 58, top 60 and bottom 62 edges of the small ceramic tiles 68 are square and flat within extremely close and tight tolerances to ensure that when placed in edge-to-edge engagement with other small ceramic tiles 68 maximum engagement is accomplished. This maximizes the strength of bond between engaging tiles, as well as minimizes any gap between adjacent small ceramic tiles 68 so as to prevent a projectile from finding a weak spot between small ceramic tiles 68.

In the arrangement shown, when the small ceramic tiles 68 are approximately 2 inches across, the amount of side-to-side curvature amounts to approximately 7°. That is, the left side 56 and the right side 58 of the small ceramic tiles 68 angle inward towards one another at approximately 7°. When four of these small ceramic tiles 68 are stacked in edge-to-edge alignment, the left-most edge angles inward towards the right-most edge at an angle of approximately 28° (or 7°+7°+7°+7°=28°). It has been tested that this amount of curvature is comfortable for a user and also provides some amount of deflection for projectiles and enhanced impact strength due to its curvature. With that said, any other amount of curvature is hereby contemplated, such as small ceramic plate curvature of 0.5°, 1°, 2°, 3°, 4°, 5°, 6°, 8°, 9°, 10°, 11°, 12°, 13°, 14°, 15°, 16°, 17°, 18°, 19°, 20°, or more or less or any amount therebetween.

In the arrangement shown, armor plate 66 is formed of five vertically stacked rows 70 of small ceramic tiles 68. Each row 70 is approximately the length of four small ceramic tiles 68 stacked in side-to-side alignment. As such, in one arrangement, armor plate 66 could be formed of only twenty total small ceramic tiles 68. However, to improve strength of armor plate 66, each row 70 is staggered with respect to the immediately above and/or below row 70. In one arrangement, as is shown, rows 70 are staggered such that the seams between two small ceramic tiles 68 fall squarely in the middle of the small ceramic tile 68 directly above and/or below the row 70. That is, said another way, the offset is 50%; or said another way, when the small ceramic tiles 68 are approximately 2 inches wide, the offset is 1 inch which is the maximum offset one tile can be to another. However any other offset is hereby contemplated from 0% to 50% offset, such as 5-10% offset, 5-20% offset, 5-25% offset, 5-30% offset, 5-40% offset, 25% offset, 33% offset, or the like.

When an offset is used, this requires the use of partial small ceramic tiles 68 to provide the generally square shape of the armor plate 66. Specifically, the armor plate 66 is formed of sixteen full small tiles 72. Corner tiles 74 are used in the outside corners of the upper most row 70. These corner tiles 74 are essentially the same as full small tiles 72 with their upper outside corner cut off or chamfered angling inward from the bottom of the plate to the top of the plate. This is done to provide room for the user's arms and makes the body armor 50 more comfortable to wear. In addition, the second row 70 down from the top row 70 and the second row 70 up from the bottom row 70 include partial side tiles 76 that are used to fill in the gaps left by the offset or staggering of the rows 70. These partial side tiles 76 are essentially half the lateral width of the full small ceramic tiles 72.

Corner tiles 74 and partial side tiles 76 are either formed in their size and shape. Alternatively, the corner tiles 74 and partial side tiles 76 are cut from full small ceramic tiles 72.

While any ceramic ballistic plate can be used for the small ceramic tiles 68, 99.5% Amumina-Oxide with Magnesium-Oxide tiles manufactured by CerCo, LLC of Shreve, Ohio have been tested with success.

The armor plate 66 is formed out of these individual small ceramic tiles 68 in the following manner. The small ceramic tiles 68 are stacked in side-to-side alignment and then bonded together to one another. Any form of bonding can be used such as coating the aligned small ceramic tiles 68 with an adhesive and baking them with heat and pressure to cure the adhesive thereby forming a solid unitary armor plate 66.

One manner and method of bonding the small ceramic tiles 68 that has been tested with success includes using 3M's Scotch-Weld™ structural adhesive film, AF 163-2 which designates a family of thermosetting modified epoxy structural adhesives in film form which are available in a variety of weights with or without a supporting carrier. The advantages of using this adhesive include: high bond strength from −67° F. to 250° F.; high fracture toughness and peel strength; excellent resistance to high moisture environments before and after curing; short cure time at ~225° F. (~90 minutes); capable of low pressure bonding; vacuum cure capability; x-ray opacity (allows for use of x-ray NDI methods); excellent shop open time for long shelf life; has a higher tack properties than other adhesive films; among countless other advantages.

Mold 77 is used to form armor plate 66 using 3M's Scotch-Weld™ structural adhesive film, AF 163-2. Mold 77 is generally made of a metallic material such as aluminum, steel or any other metallic material. Mold 77 has a generally flat elongated body 77A with a lip 77B positioned at its lower edge that protrudes upwardly from the elongated body 77A. A curved portion 77C curves upwardly from the upper surface of the main body 77A. Curved portion 77C connects at its lower end to the inside edge of lip 77B. The curved portion 77C is sized and shaped to match the curvature of small ceramic tiles 68. In one arrangement, the upper surface of main body 77A, and curved portion 77C, as well as the inside edge of lip 77B are covered or coated with a non-stick surface. The nonstick surface prevents the structural adhesive film from sticking to these surfaces of mold 77. In one arrangement, the nonstick surface is Teflon tape or Teflon coating.

Figure 5:
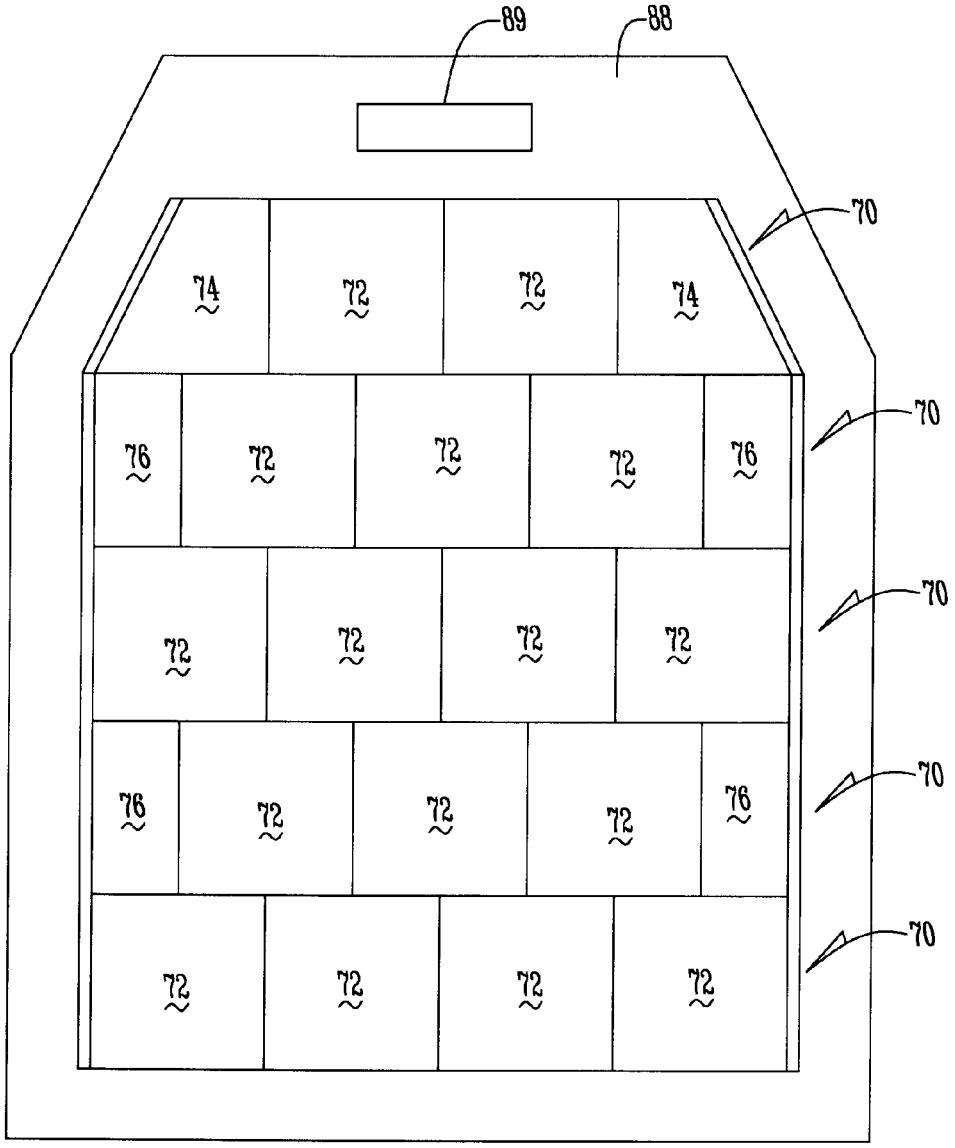
FIG. 5 is a plan view of the back side of a plurality of small curved ceramic tiles aligned to form an armor plate, the arrangement showing a staggered arrangement of a plurality of rows, and the use of corner tiles as well as partial side tiles.
Figure 6:
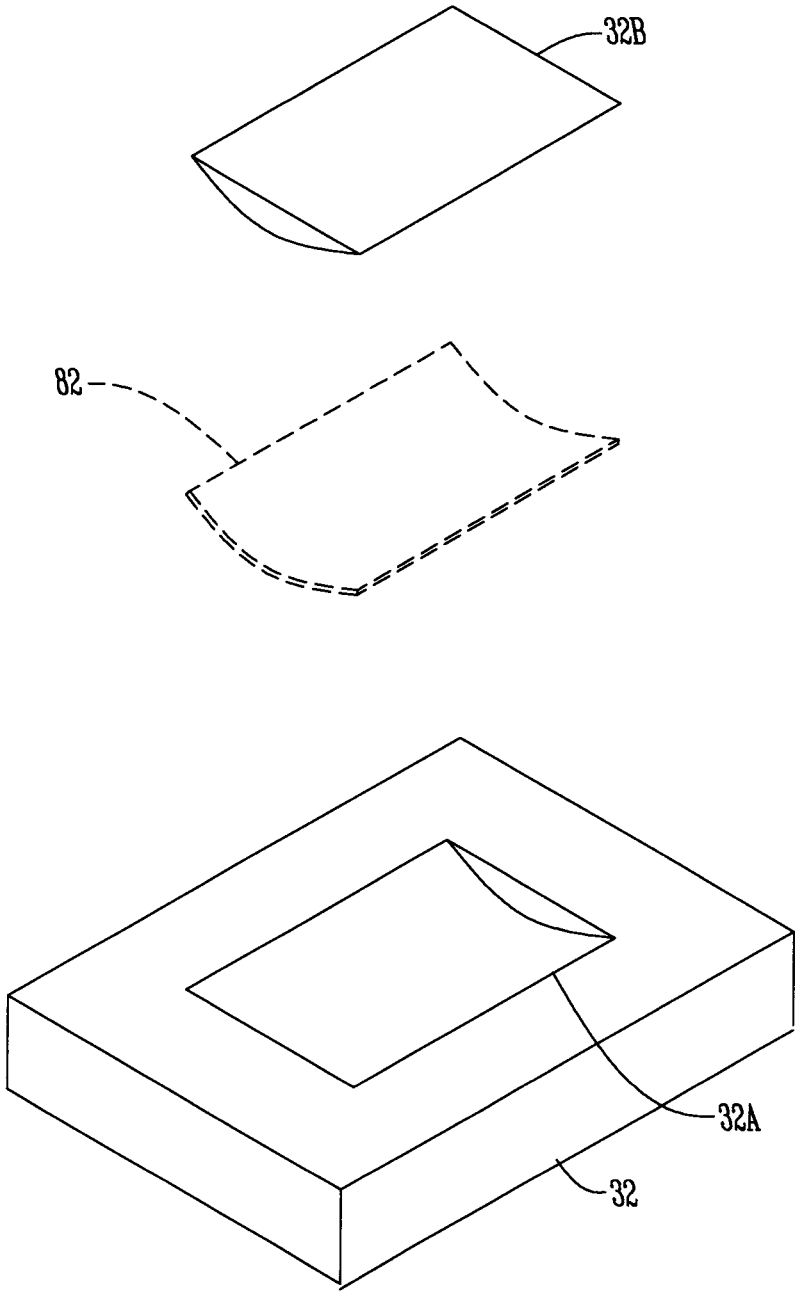
FIG. 6 is a perspective view of a mold used to apply pressure, vacuum and/or heat to form components of the body armor, such as the armor plate, the rigid backing plate and/or finish the assembly of the entire body armor.
Figure 7:
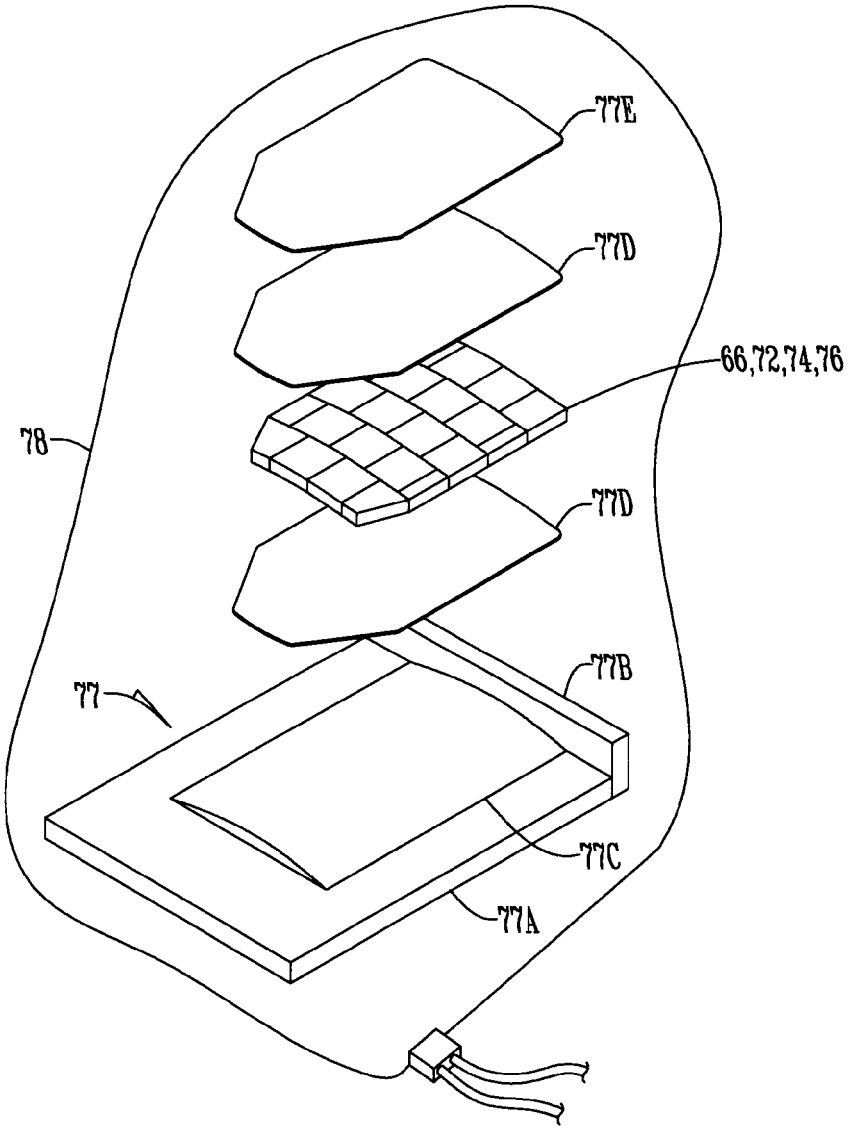
FIG. 7 is a perspective blown up view of an armor plate formed on a mold and positioned within a vacuum bag, the armor plate being formed of a plurality of curved square tiles with a layer of structural adhesive positioned on the top side and bottom side of the ceramic tiles, and a release film positioned over the top of the assembly.

To form armor plate 66, the protective backing is removed from a first layer of structural adhesive film 77D and the adhesive film 77D is laid on and over the curved portion 77C of mold 77. Next, the plurality of full small ceramic tiles 72, corner tiles 74 and partial side tiles 76 are assembled in end to end relation with one another as is depicted in the arrangement shown in FIG. 5. Once the tiles 72, 74, 76 are assembled, a second layer of structural adhesive film 77D is applied over the front side 52 of the aligned small ceramic tiles 72, 74, 76. The structural adhesive film 77D in one arrangement is cut to shape such that it only extends to the outside edges of the small ceramic tiles 68; in an alternative arrangement, the structural adhesive film 77D wraps around the exterior edge of the small ceramic tiles 68 in partial overlapping condition where some of the edge of the small ceramic tiles 68 is left exposed, or alternatively in full overlapping condition where the entirety of the edge of the small ceramic tiles 68 is covered. Once the structural adhesive film 77D is placed over the aligned small ceramic tiles 68, the mold is placed in a vacuum bag 78. A release film 77E is positioned over the top surface of the structural adhesive film 77D to prevent the structural adhesive film 77D The vacuum bag 78 is large enough to hold a plurality of molds 77 at a single time, as many as 5, 10, 15, 20, 25, 30, 35 or more molds. Next, the adhesive coated armor plate 66 is placed in an autoclave, oven or kiln, the vacuum bag 78 is connected to a vacuum source and vacuumed to an effective pressure. In one arrangement, an effective pressure is between 1 psi and 100 psi, more specifically between 1 psi and 100 psi, more specifically, between 5 psi and 50 psi, and more specifically between 10 psi and 30 psi, and more specifically approximately 20 psi. Simultaneously, the bagged armor plate 66 is baked or heated at an effective temperature for an effective amount of time. The effective temperature is between 100° F. and 650° F., more specifically between 200° F. and 400° F., more specifically between 200° F. and 350° F., more specifically between 200° F. and 300° F., more specifically between 225° F. and 250° F., and more specifically approximately 225° F., however any other temperature is hereby contemplated. The effective amount of time is between 10 minutes and 6 hours, more specifically between 20 minutes and 4 hours, more specifically between 25 minutes and 3 hours, more specifically between 3 minutes and 2 hours, more specifically between 30 minutes and 90 minutes, and more specifically between 30 minutes and 60 minutes, and more specifically approximately 30 minutes, however any other amount of time is hereby contemplated. That is, in one arrangement a temperature of approximately 225° F.+/−25° F. is used for approximately 30 minutes+/−30 minutes. In one arrangement, vacuum is maintained after heating has been terminated until the arrangement, including mold 77 and armor plate 66, have cooled to below 200° F., more specifically to below 175° F., more specifically to below 150° F., more specifically to below 120° F., more specifically to below 100° F. In another arrangement, one or more armor plates 66, such as 2, 3, 4, 5, 10, 15, 20 or more, are stacked vertically in the mold 30 with spacers therebetween and cured together under vacuum. Once the armor plate 66 is heated and cooled, the single monolithic armor plate is removed from the mold 32 and vacuum bag 78.

Positive results have been achieved by pumping the vacuum bag 78 down to approximately 20 psi, baking the assembly from room temperature to approximately 225° F. for approximately 30 minutes, removing the tent, and continuing to pull 20 psi from the vacuum bag 78 until the assembly cools to approximately 120° F.

This arrangement results in structural adhesive film 77D coating the entire front side 52 and back side 54 of the armor plate 66. In addition an amount of structural adhesive film 77D flows between the seams of the individual small ceramic tiles 68. In addition, depending on the application, the exterior edge of the small ceramic tiles 68 are also coated with structural adhesive film 77D. This continuous film and the penetration between the seams adds to the strength and rigidity and durability of the armor plate 66.

Another advantage of the arrangement of using a plurality of small ceramic tiles 68 to form a unitary armor plate 66 is that x-ray testing is not required, which saves cost and a manufacturing step. This is because the small size of the small ceramic tiles 68 and the utilization of the structural adhesive film 77D do not allow for micro-cracks that affect the performance of the body armor 50 as any micro-crack would terminate at the intersection of two small ceramic tiles 68. This is in contrast to when the armor plate is formed of a single continuous piece of ceramic wherein a micro crack can extend across the length of the entire plate. In addition, by coating the armor plate 66 in structural adhesive film 77D this helps the small ceramic tiles 68 prevent new cracks from forming during standard wear and tear. That is, the structural adhesive film 77D provides a layer of protection to the armor plate 66 which improves the longevity and durability of the body armor.

Third Layer—Ballistic Material:

The third layer 80 is a layer of ballistic material. The third layer 80 may be made of a single layer of ballistic material or made of multiple layers of ballistic material. The third layer 80 of ballistic material serves as a large footprint to soak up energy from the projectile when struck. The ballistic material helps to prevent the projectile from passing through the layer.

In one arrangement, the third layer 80 is made of one or multiple layers of an aramid-type material such as Kevlar or Kevlar® XP, or any other aramid-type material or ballistic material. It is hereby contemplated that the third layer 80 is made of a single layer, or as many as 2 layers, 3 layers, 4 layers, 5 layers, 6 layers, 7 layers, 8 layers, 9 layers, 10 layers, 11 layers, 12 layers, 13 layers, 14 layers, 15 layers, 20 layers, 25 layers, 30 layers, 50 layers or up to or 100 layers or any amount in between, or more layers of ballistic material. In one arrangement, a single layer of Kevlar XP is used, it is published that a single layer of Kevlar XP has the density of 11 layers of Kevlar. As such, it is hereby contemplated that 11 layers of Kevlar can be used to replace the single layer of Kevlar XP for equivalent results.

In this arrangement, the single or multiple layers of ballistic material are cut to the same dimensions and laid in flat-overlapping condition with one another. The layers are either counted by hand or by machine to ensure that the appropriate number of layers are used. Alternatively, the layers are weighed to ensure the appropriate number of layers are used.

In one arrangement, these layers of material are simply laid in loose overlapping condition without being adhered or bound to one another. In an alternative arrangement, these layers of material are bound or adhered to one another using an adhesive, stitching, welding, gluing, or any other manner of connection. In an alternative arrangement, the third layer 80 of ballistic material comes as a single sheet comprised of the multiple layers as is described herein.

Fourth Layer—Rigid Backing Plate:

The fourth layer 82 is a rigid backing plate. The fourth layer 82 rigid backing plate also serves as a large footprint which soaks up energy from the projectile when struck but adds structural rigidity as this layer is inherently rigid in nature. Due to its rigidity, the fourth layer 82 rigid backing plate also serves to reduce or prevent back face deformation ("BFD") or back face signature ("BFS").

In one arrangement, the fourth layer 82 is made of a polyethylene fiber or ultra-high-molecular-weight polyethylene fiber (UHMWPE") that is strong, thin, light, and has good impact resistance as well as good energy dispersal characteristics. Spectra® and/or Spectra Shield® and/or Spectra Shield® II fiber manufactured by Honeywell has been tested with success as the fourth layer 82. In one arrangement, Spectra Shield® II SR-3136 and SR-3137 have been used with success.

Spectra® or Spectra Shield® fiber is a bright white polyethylene fiber that is produced using a gel-spinning process. Pound-for-pound, it is 15 times stronger than steel, more durable than polyester and has a specific strength that is 40 percent greater than aramid fiber. Polyethylene is a remarkably durable plastic. Spectra® is one of the world's strongest and lightest fibers. The gel-spinning process and subsequent drawing steps allow Spectra fiber to have a much higher melting temperature (150° C. or 300° F.) than standard polyethylene.

Spectra® displays outstanding toughness and extraordinary visco-elastic properties, Spectra® fiber can withstand high-load strain-rate velocities. Light enough to float, it also exhibits high resistance to chemicals, water, and ultraviolet light. It has excellent vibration damping, flex fatigue and internal fiber-friction characteristics, and Spectra fiber's low dielectric constant makes it virtually transparent to radar.

In this arrangement 1 to 100 layers are used, more specifically 10 to 50 layers, more specifically 20 to 40 layers, and more specifically approximately 36 layers are used. These layers are placed in overlapping condition with one another. The layers are either counted by hand or by machine to ensure that the appropriate number of layers are used. Alternatively, the layers are weighed to ensure the appropriate number of layers are used.

Once stacked, the layers are placed in a female cavity 32A of mold 32 and pressed by male plunger 32B while heat is added. In one arrangement a plurality of rigid backing plates 82 are formed at a single time by stacking the layers of material and separating them by a spacer, such as a curved piece of steel, aluminum or other spacing material.

In one arrangement, the layers of material include or are impregnated with an adhesive, binder or other material which when pressed and/or heated bonds to adjacent layers of material. In one arrangement, the layers are stacked in mold 32 and pressed at an effective pressure for an effective amount of time. In one arrangement an effective pressure is between 100 lbs./in$^2$ and 5000 lbs./in$^2$, more specifically between 1000 lbs./in$^2$ and 3000 lbs./in$^2$, more specifically between 1500 lbs./in$^2$ and 2750 lbs./in$^2$, and more specifically approximately 2500 lbs./in$^2$. In one arrangement an effective amount of time is between 10 minutes and 4 hours, more specifically between 20 minutes and 2 hours, more specifically between 30 minutes and 90 minutes, more specifically between 30 minutes and 60 minutes, and more specifically for approximately 30 minutes. In one arrangement, the effective pressure is maintained on the mold 32 until the temperature of the mold 32 drops below an effective cool temperature, which in one arrangement is below 200° F., or below 175° F., or below 150° F., or below 120° F., or below 100° F. In this arrangement, the press begins at approximately at room temperature and ends at approximately room temperature with and heat added over time until the assembly heats to the effective temperature. The combination of the heat and pressure and time causes the multiple layers to form a single unitary rigid piece that resists delamination and back face deformation or back face signature.

In an alternative arrangement, the layers of material of the ballistic material 80 are pressed with the layers of material of the fourth layer 82 to form a rigid backing plate comprised of the third layer 80 and the fourth layer 82. That is, the aramid-type material is pressed with the UHMWP-type material to form a single piece.

Fifth Layer 84—Cover Material:

The fifth layer 84 or rear cover layer of body armor 50 provides the back exterior surface of the body armor 50. In one arrangement, this fifth layer 84 is formed of the same material as the first layer 64, and therefore reference is made thereto.

Foam Layer:

A foam layer 86 is positioned around the exterior edges of armor plate 66. In one arrangement, the armor plate 66 is approximately ½ of an inch thick, and is approximately 1 inch smaller in side-to-side and top-to-bottom size than rigid backing plate 82 and ballistic material 80. The foam layer 86 is positioned in this exposed region 88 of third layer 80. The foam layer 86 fills in the gap or step between exposed region 88 of third layer 80 and the front of the armor plate 66 so as to provide a flat and flush front surface. That is, when in position, the front of foam layer 86 and armor plate 66 are in parallel with one another.

Any foam material is used and hereby contemplated for use as foam layer 86. A high-density, durable and strong foam material has been used with success. In one arrangement, foam layer 86 is punched out of a single sheet of foam material. This reduces assembly time and provides a strong and durable design. In this arrangement, the interior edge of the punched-out region of the foam layer is sized and shaped within close tolerances to fit the exterior edge of armor plate 66. The exterior edge of foam layer 86 is sized and shaped to fit and align with the exterior edge of the other components of body armor 50.

This foam layer 86 also provides a suitable area for mounting an electronic component 89 therein. That is, in one arrangement, an electronic component 89 is connected to, mounted in, or otherwise held by foam layer 86. Electronic component 89 includes a GPS tracking device, a ballistic impact sensor, a communications module (such as a cell phone type module, a radio, or the like), an RFID tag, a video or audio recording device, a computing device or any other electronic component. The compressible nature foam layer 86 and its position approximate the other rigid components of body armor 50 provide an excellent mounting structure as well as providing protection for the sensitive electronic components. In one arrangement the electronic component 88 includes a battery which is charged by way of inductive charging and/or motion powered such that when the body armor 50 is worn, the electronic component is powered and/or charged by the motion of the wearer. In an alternative arrangement, electronic component 89 is connected to any other portion of body armor 10/50.

Foam Piping:

Once the internal components of the body armor 50 are assembled, foam piping 90 is positioned around the exterior edge. Any foam material is used and hereby contemplated for use as foam piping 90. A high-density, durable and strong foam material has been used with success. In one arrangement, foam piping 90 comes in a roll and has a layer of adhesive on an interior edge, or alternatively on an interior and exterior edge, which adheres to the other components of body armor 50. The foam piping 90 is sized and shaped to be approximately the width of the edge of the other components of body armor 50. In one arrangement, 1 inch wide #2 density crosslink KE with EVA foam tape of approximately 0.0625 inch thickness with 3M #950 PSA adhesive on one side has been used with success. Foam piping 90 provides some level of cushion around the exterior edge of body armor 50.

Fabric Band:

A fabric band 92 is positioned around the exterior edge of body armor 50. Fabric band 92 is formed of any suitable material such as polyester, nylon, a ballistic material or the like. The fabric band 92 overlaps a portion of the front cover material 64, extends across the entire edge and overlaps a portion of the rear cover material 84. In one arrangement, black #F72 83% Nylon 17% Lycra has been used with success.

Assembly:

This embodiment is assembled in the following manner.

The third layer 80, the ballistic material, is connected to the back 54 side of the armor plate 66 using an adhesive. Any adhesive is hereby contemplated for use. In one arrangement, a single layer of 3M™ adhesive transfer tape 9485PC has been used with success. 9485PC is a high performance acrylic adhesive. 9485PC provides high tack and shear strength, excellent temperature and solvent resistance, excellent adhesion to plastics and foams and can be used for joining materials that are relatively smooth, thin and have low residual stress. 9485PC is designed for temperature exposure to 450 degree Fahrenheit for short periods of time and is ideal for bonding a wide variety of similar and dissimilar materials. As such, it is durable and provides a long useful life and strong bond. Once bonded together, the exposed region 88 extends around the exterior edge of the armor plate 66.

The fourth layer 82 is connected to the back 54 side of the third layer 80, the ballistic material by way of adhesive. Any adhesive is hereby contemplated for use. In one arrangement, the same adhesive tape 9485PC is used in a similar manner described above with respect to the connection of the third layer 80 to the armor plate 66.

The foam layer 86 is connected to the front 52 surface of the exposed region 88 of the second third layer 80, the ballistic material. Any adhesive is used to connect the foam layer 86 to the third layer 80. In the arrangement shown, since the front side of the third layer 80 the ballistic material is covered with an adhesive tape, the foam layer 86 simply sticks to this exposed region 88 of adhesive tape.

Once the internal components of the body armor 50 are assembled, the foam piping 90 is wrapped around the exterior edge of the body armor. The foam piping 90 is adhered using adhesive tape or any other adhesive.

After the foam layer 86 is adhered around the armor plate 66, and the foam piping 90 is wrapped around the body armor 50, the first layer 64, the front cover material, is connected to the front of the body armor. To do so, adhesive is applied to the front surface 52 of the armor plate 66 and adhesive is applied to the rear 54 surface of the front cover material 64. Any adhesive is hereby contemplated for use. In one arrangement, 3M™ Scotch-Weld™ Nitrile High Performance Plastic Adhesive 1099L has been used with success. 1099L is a low viscosity, fast drying and heat curable plastic adhesive. It resists weathering, water, oil, plasticizer migration, and alphalitic fuels. As such, it is durable and provides a long useful life and strong bond. Once the two surfaces are coated and the adhesive is allowed to partially set-up or become sticky, the two components are connected to one another.

A similar process is used to connect the fifth layer 84, the rear cover material to the back 54 side of the fourth layer 82, the rigid backing plate 82. That is, in one arrangement the 1099L adhesive is used.

Once these components are fully assembled the fabric band 92 is wrapped around the exterior edge of the body armor 50 and adhered thereto. Any adhesive is hereby contemplated for use. In one arrangement, the 1099L adhesive is used as is described herein. Care is taken to ensure that a certain portion of the fabric band 92 overlaps itself (approximately 1 inch) to ensure complete coverage of the internal components.

In an alternative arrangement of assembly, the first layer 64 is stitched to the fabric band 92 and the fifth layer 84 is adhered to the back side of the fourth layer 82 either using adhesive or an adhesive tape as is described herein. Next, the first layer 64 with attached fabric band 92 is placed over the other components of the body armor 50 and the fabric band 92 is adhered to the body armor 50 using adhesive or adhesive tape as is described herein.

After the body armor 50 is fully assembled, in another arrangement a plurality of body armor 50 plates are stacked on top of one another and pressure and/or heat are applied for an extended period of time to force the multiple layers into engagement with one another, to activate and cure the various layers of adhesive, thereby forming a more-dense and rigid body armor 50.

In this way an improved body armor is formed.

In Use: As a projectile strikes the front 52 of the body armor 50, the projectile passes through the front cover material 64. Next, the projectile strikes the armor plate 66. Specifically, the projectile strikes one or more small ceramic tiles 68 (72, 74, 76). This causes the stricken small ceramic tiles 68 to fracture. This causes the projectile to transfer a great amount of energy to the armor plate 66. While the stricken small ceramic tiles 68 fracture, the adjacent small ceramic tiles 68 remain unbroken and able to absorb additional projectiles without degradation of effectiveness. Further, the structural adhesive film on both the front 52, back 54 and between the various individual small ceramic tiles 68 helps to hold the plurality of ceramic plates 68 together and prevent fractures across the entire armor plate 66.

After striking the armor plate 66, the projectile and/or the force thereof, engages the ballistic material 80. Due to the features of the ballistic material 80 this layer acts as a catcher's mitt and absorbs additional energy from the projectile. The long molecules and strands of the ballistic material 80 help to resist the projectile passing through the ballistic material 80.

Next, the remaining force of the projectile is absorbed by the rigid backing plate 82. Due to the structural rigidity of the backing plate 82, the force of the projectile is absorbed with minimal back face deformation ("BFD") or back face signature ("BFS").

In this way, the body armor 50 stops multiple projectiles and thereby saves lives. That is, by having a plurality of small ceramic tiles 68, each of these small ceramic tiles 68 act as their own independent piece of body armor and are unaffected by impacts to the surrounding small ceramic tiles 68. Furthermore, by coating the plurality of small ceramic tiles 68 with structural adhesive film 77D this provides additional rigidity to the assembly. In addition, by adhering each layer to the other, this improves the rigidity of the entire assembly, which further improves the density of the assembly and helps to stop projectiles.

Alternative Embodiments: While a chest plate has been presented herein, the invention is not so limited. Other embodiments and manners of using the technology presented herein are also contemplated. This includes side plates for a person's torso, shoulder plates, helmets, groin plates, or plates for any other portion of a person's body. The technology can also be incorporated into panels for vehicles. It is also hereby contemplated to place plates under the seat of combat aircraft such as helicopters, planes, jets or the like.

Accordingly, a new, useful and nonobvious body armor and method of making the same is presented. From the above discussion it will be appreciated that the body armor 10 presented provides a substantial improvement upon the state of the art. Specifically, the body armor presented is lightweight, is inexpensive and simple to manufacture, can sustain multiple ballistic impacts, can sustain high ballistic impacts, breaks apart the projectile, all while being comfortable to wear.

It will be appreciated by those skilled in the art that other various modifications could be made to the device without parting from the spirit and scope of this invention. All such modifications and changes fall within the scope of the claims and are intended to be covered thereby.

What is claimed:

1. Multi-layer multi-impact ballistic body armor formed of a plurality of layers, comprising:

a first layer, wherein the first layer is a front cover material;

a second layer, wherein the second layer is an armor plate;

a third layer, wherein the third layer is a ballistic material;

a fourth layer, wherein the fourth layer is a rigid backing plate;

a fifth layer, wherein the fifth layer is a rear cover material;

wherein the armor plate is formed of a plurality of small ceramic tiles;

wherein the plurality of small ceramic tiles are placed in edge-to-edge engagement;

wherein structural adhesive film is placed on a forward side of the armor plate and a rearward side of the armor plate;

wherein when activated the structural adhesive film bonds the plurality of small ceramic tiles into a single unitary and rigid armor plate;

wherein when activated the structural adhesive film partially penetrates seams between small ceramic tiles thereby improving bonding between adjacent small ceramic tiles;

wherein the plurality of layers provide protection to ballistic impacts;

wherein the ballistic material is positioned behind the armor plate and in front of the rigid backing plate;

wherein the rigid backing plate is positioned behind the ballistic material;

wherein the ballistic material is in engagement with or bonded to the rearward side of the armor plate;

wherein the ballistic material is formed of an aramid-type material;

wherein the rigid backing plate is in engagement with or bonded to a rearward side of the ballistic material;

wherein when the multi-layer multi-impact ballistic armor is struck by a projectile, the armor plate serves to absorb and disperse energy from the projectile as the stricken small ceramic tile or tiles break upon impact;

wherein when the multi-layer multi-impact ballistic armor is struck by a projectile, the ballistic material serves to absorb and disperse energy from the projectile and catch the stricken small ceramic tile or tiles;

wherein when the multi-layer multi-impact ballistic armor is struck by a projectile, the rigid backing plate serves to absorb and disperse energy from the projectile and to prevent or reduce back face deformation.

2. The multi-layer multi-impact ballistic body armor of claim 1 wherein when the multi-layer multi-impact ballistic armor is struck by a projectile, and the stricken small ceramic tile or tiles break upon impact, the stricken small ceramic tile or tiles serve to break the projectile apart.

3. The multi-layer multi-impact ballistic body armor of claim 1 wherein the front cover material and the rear cover material are formed of a water resistant or water proof material.

4. The multi-layer multi-impact ballistic body armor of claim 1 wherein when the multi-layer multi-impact ballistic armor is struck by a projectile, and the stricken small ceramic tile or tiles break upon impact, the structural adhesive serves to hold the remaining small ceramic tiles in alignment with one another and wherein the small ceramic tiles prevent crack propagation across the armor plate.

5. The multi-layer multi-impact ballistic body armor of claim 1 wherein body armor is curved from side to side.

6. The multi-layer multi-impact ballistic body armor of claim 1 wherein the plurality of small ceramic tiles that are stacked in a plurality of rows, wherein the stacked rows are offset from one another such that seams between small ceramic tiles of one row are misaligned with seams of immediately adjacent rows thereby improving strength of the armor plate.

7. The multi-layer multi-impact ballistic body armor of claim 1 wherein the armor plate is between ¼ of an inch and 1 inch in thickness.

8. The multi-layer multi-impact ballistic body armor of claim 1 wherein the armor plate is formed of a plurality of small ceramic tiles which are curved.

9. The multi-layer multi-impact ballistic body armor of claim 1 wherein the armor plate is formed of a plurality of small ceramic tiles which are approximately square, rectangular, hexagonal, heptagonal, pentagonal, octagonal, or trapezoidal in shape.

10. The multi-layer multi-impact ballistic body armor of claim 1 wherein the ballistic material is formed of a plurality of layers of an aramid-type material.

11. The multi-layer multi-impact ballistic body armor of claim 1 wherein the ballistic material is formed Kevlar® and/or Kevlar XP®.

12. The multi-layer multi-impact ballistic body armor of claim 1 wherein the ballistic material is formed of a plurality of between 2 and 100 layers.

13. The multi-layer multi-impact ballistic body armor of claim 1 wherein the rigid backing plate is formed of between 1 and 100 layers.

14. The multi-layer multi-impact ballistic body armor of claim 1 wherein the rigid backing plate is formed of a plurality of layers of ultra-high molecular weight polyethylene.

15. The multi-layer multi-impact ballistic body armor of claim 1 wherein the rigid backing plate is formed of a plurality of layers of Spectra® and/or Spectra Shield®.

16. The multi-layer multi-impact ballistic body armor of claim 1 further comprising an electronic component connected to the body armor.

17. The multi-layer multi-impact ballistic body armor of claim 1 further comprising a foam layer positioned around the armor plate.

18. The multi-layer multi-impact ballistic body armor of claim 1 wherein the front cover material is adhered to the armor plate.

19. The multi-layer multi-impact ballistic body armor of claim 1 wherein the armor plate is adhered to the ballistic material.

20. The multi-layer multi-impact ballistic body armor of claim 1 wherein the ballistic material is adhered to the rigid backing plate.

21. The multi-layer multi-impact ballistic body armor of claim 1 wherein the rigid backing plate is adhered to the rear cover material.

* * * * *